US012227280B2

(12) United States Patent
Kirihara et al.

(10) Patent No.: US 12,227,280 B2
(45) Date of Patent: Feb. 18, 2025

(54) SHIP STEERING DEVICE

(71) Applicant: Hitachi Astemo, Ltd., Hitachinaka (JP)

(72) Inventors: Kenichi Kirihara, Hitachinaka (JP); Norio Kikuchi, Hitachinaka (JP); Yusuke Amma, Hitachinaka (JP); Kyohei Fukushi, Hitachinaka (JP); Akihiro Kogure, Hitachinaka (JP)

(73) Assignee: HITACHI ASTEMO, LTD., Hitachinaka (JP)

( * ) Notice: Subject to any disclaimer, the term of this patent is extended or adjusted under 35 U.S.C. 154(b) by 469 days.

(21) Appl. No.: 17/665,715

(22) Filed: Feb. 7, 2022

(65) Prior Publication Data

US 2022/0306264 A1 Sep. 29, 2022

(30) Foreign Application Priority Data

Mar. 23, 2021 (JP) ..... 2021-048133

(51) Int. Cl.
*B63H 25/42* (2006.01)
*B63H 25/24* (2006.01)

(52) U.S. Cl.
CPC ..... *B63H 25/42* (2013.01); *B63H 25/24* (2013.01)

(58) Field of Classification Search
CPC ..... B63H 25/42; B63H 25/24
See application file for complete search history.

(56) References Cited

U.S. PATENT DOCUMENTS

| | | | | |
|---|---|---|---|---|
| 7,267,069 | B2 * | 9/2007 | Mizutani | B63H 25/24 114/144 R |
| 2006/0217012 | A1 * | 9/2006 | Mizutani | B63H 20/12 440/61 S |
| 2008/0115713 | A1 * | 5/2008 | Mizutani | B63H 20/12 440/53 |
| 2008/0125925 | A1 * | 5/2008 | Mizutani | B63H 25/02 701/21 |
| 2019/0377347 | A1 * | 12/2019 | Mizutani | G05D 1/0206 |
| 2022/0306264 | A1 * | 9/2022 | Kirihara | B63H 20/12 |
| 2022/0315194 | A1 * | 10/2022 | Kirihara | B63H 25/42 |

FOREIGN PATENT DOCUMENTS

| | | | | |
|---|---|---|---|---|
| EP | 3578454 | A1 * | 12/2019 | B63H 20/12 |
| JP | 2006-219131 | | 8/2006 | |
| JP | 2006219131 | A * | 8/2006 | B63H 25/02 |
| JP | 2008-1206 | A | 1/2008 | |

* cited by examiner

*Primary Examiner* — S. Joseph Morano
*Assistant Examiner* — Jovon E Hayes
(74) *Attorney, Agent, or Firm* — Rankin, Hill & Clark LLP

(57) ABSTRACT

A ship steering device includes a handle which is mechanically separated from a rudder mechanism, a steering angle detecting unit that detects a steering angle of the handle, a reaction force motor that generates reaction force torque to be applied to the handle, and a reaction force controller that controls, based on a steering characteristics map, the reaction force motor in such a way that the reaction force torque in accordance with the steering angle is obtained. The steering characteristics map has characteristics in such a way that the amount of change in an aiming steering torque relative to the steering angle is smaller in a second steering range where the steering angle is larger than that in a first steering range than the first steering region where the steering angle is set in advance from zero.

9 Claims, 12 Drawing Sheets

SHIP STEERING DEVICE

FIELD OF THE INVENTION

The present disclosure relates to a ship steering device.

BACKGROUND

Electrically assisted hydraulic steering technologies are now adopted to ship steering devices. Regarding the electrically assisted hydraulic steering, however, there is a leeway for an improvement in view of a steering feeling and/or of a ship response performance. Hence, in recent years, a development of a so-called steer-by-wire ship steering device that employs a structure, in which a handle at a driver's seat and a rudder mechanism of an outboard motor mechanically separated from each other, is advancing. For example, following Patent Document 1 discloses a conventional technology relating to the ship steering device of this type.

According to the ship steering device disclosed in Patent Document 1, the handle at the driver's seat is mechanically separated from the rudder mechanism of the outboard motor, and the handle is also capable of electrically operating the rudder mechanism. That is, the turning force or the steered force of the rudder mechanism is produced by an electric motor controlled based on the steering angle of the handle. At this time, reaction force in accordance with the steering operation is applied to the handle from a handle motor (a reaction force motor). Thus, a ship handling person can turn the steering wheel while feeling the reaction force as the response of a steering operation. Note that this handle motor functions as a return motor for returning the handle to a neutral position after the handle is turned for the steering operation.

[Patent Document 1] JP 2006-219131 A

When, however, the steer-by-wire system is adopted as disclosed in Patent Document 1, and when merely the reaction force is applied to the handle from the reaction force motor, in comparison with conventional steering devices that have a handle and a rudder mechanism mechanically coupled to each other, the ship handling person may feel strangeness in the steering operation. For example, a difference in feeling at the right and left sides is likely to occur in the response performance of a ship due to the water propelling characteristics of a propeller of the outboard motor. Hence, a ship steering device is desired which improves the controllability in comparison with conventional technologies.

An objective of the present disclosure is to provide a ship steering device that has an improved controllability.

SUMMARY OF THE INVENTION

The inventors of the present disclosure noticed that, upon keen examination, the steering torque differs in a region where the steering angle is small and in the region where the steering angle becomes large when a ship handling person feels the behavior of a ship in the ship handling person's body, carries out the steering operation while checking the state of the ship, and the ship handling person turns the handle. Moreover, the inventors of the present disclosure found that a ship steering device that has a further improved controllability can be obtained by associating the relationship between the steering angle of the handle with an aiming steering torque required for the handle by a steering characteristics map. The present disclosure has been made in view of such finding. The present disclosure has been made in view of the foregoing, and an objective is to provide a ship steering device that prevents an occurrence of strange feeling in a steering operation in a steer-by-wire type ship.

The present disclosure will be described below.

According to the present disclosure, a ship steering device is provided which includes:

- an outboard motor attachable to a ship;
- a handle which is mechanically separated from a rudder mechanism of the outboard motor, and which is capable of electrically operating the rudder mechanism;
- a steering angle detecting unit that detects a steering angle of the handle;
- a reaction force motor that generates reaction force torque to be applied to the handle;
- a storing unit that stores a steering characteristics map which associates a basic relation between the steering angle and an aiming steering torque required for the handle; and
- a reaction force controller that controls, based on the steering characteristics map, a drive current value which drives the reaction force motor in such a way that the reaction force torque in accordance with the steering angle is obtained,
- in which the steering characteristics map has characteristics in such a way that an amount of change in the aiming steering torque relative to the steering angle is smaller in a second steering range where the steering angle is larger than the steering angle in a first steering range than a change amount of the aiming steering torque in the first steering region where the steering angle is set in advance from zero.

According to the present disclosure, a ship steering device which has an improved controllability can be provided.

DETAILED DESCRIPTION OF THE EMBODIMENTS

Embodiments of the present disclosure will be described with reference to the accompanying figures. Note that the embodiments illustrated in the figures are merely examples of the present disclosure, and the present disclosure is not limited to such embodiments. In the following description, the right and left sides mean respectively the right and left sides with reference to a straight-traveling state of a ship, and the front and rear sides mean respectively the front and rear sides with reference to the straight-traveling state of the ship. Moreover, in the figures, Fr, Rr, Li, and Ri indicate the front side (a traveling direction), the rear side (the opposite direction to the traveling direction), the left side, and the right side, respectively.

First Embodiment

Figure 1:
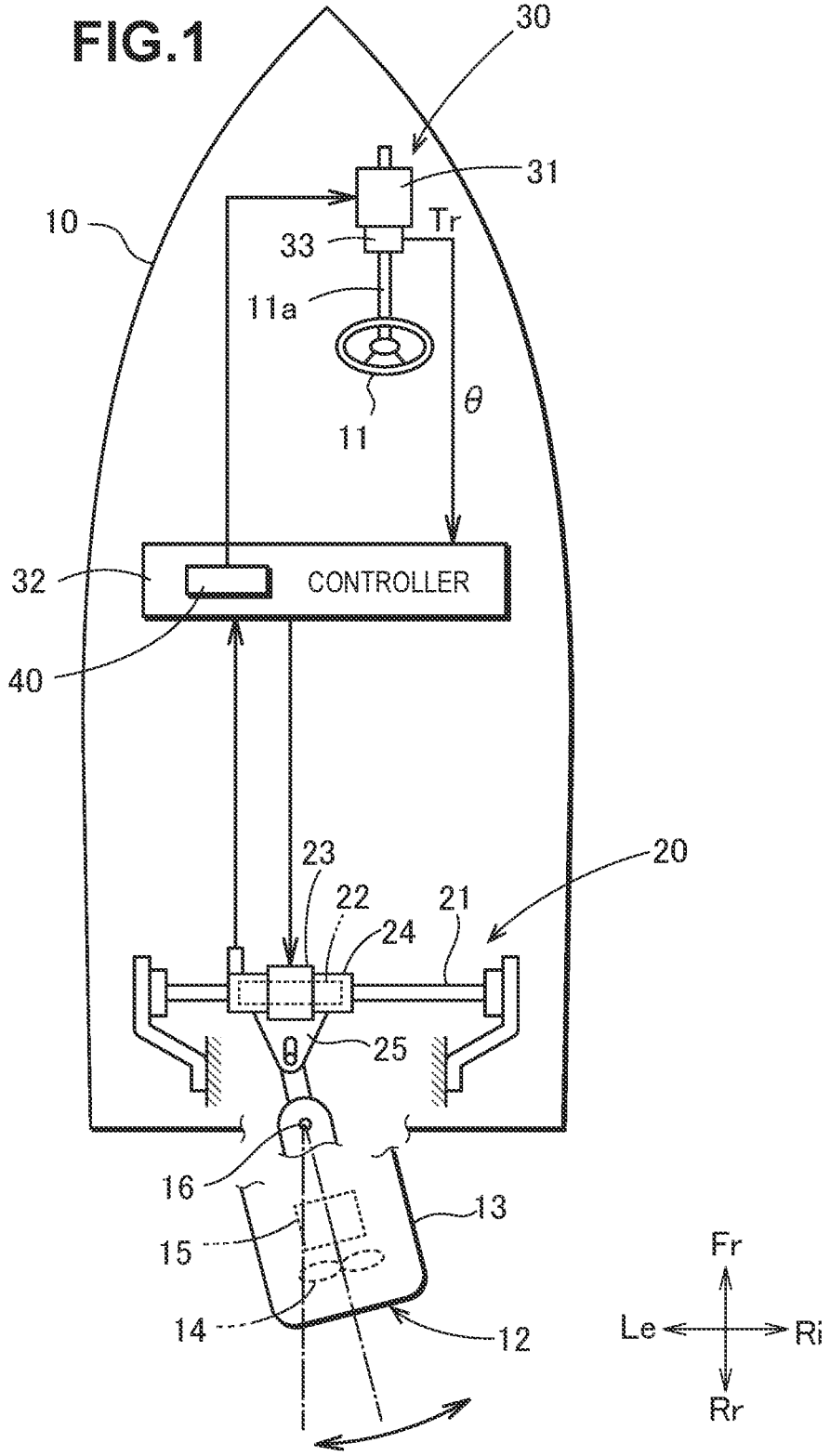
FIG. 1 is a planar schematic diagram of a ship on which a ship steering device according to a first embodiment is loaded.
Figure 2:
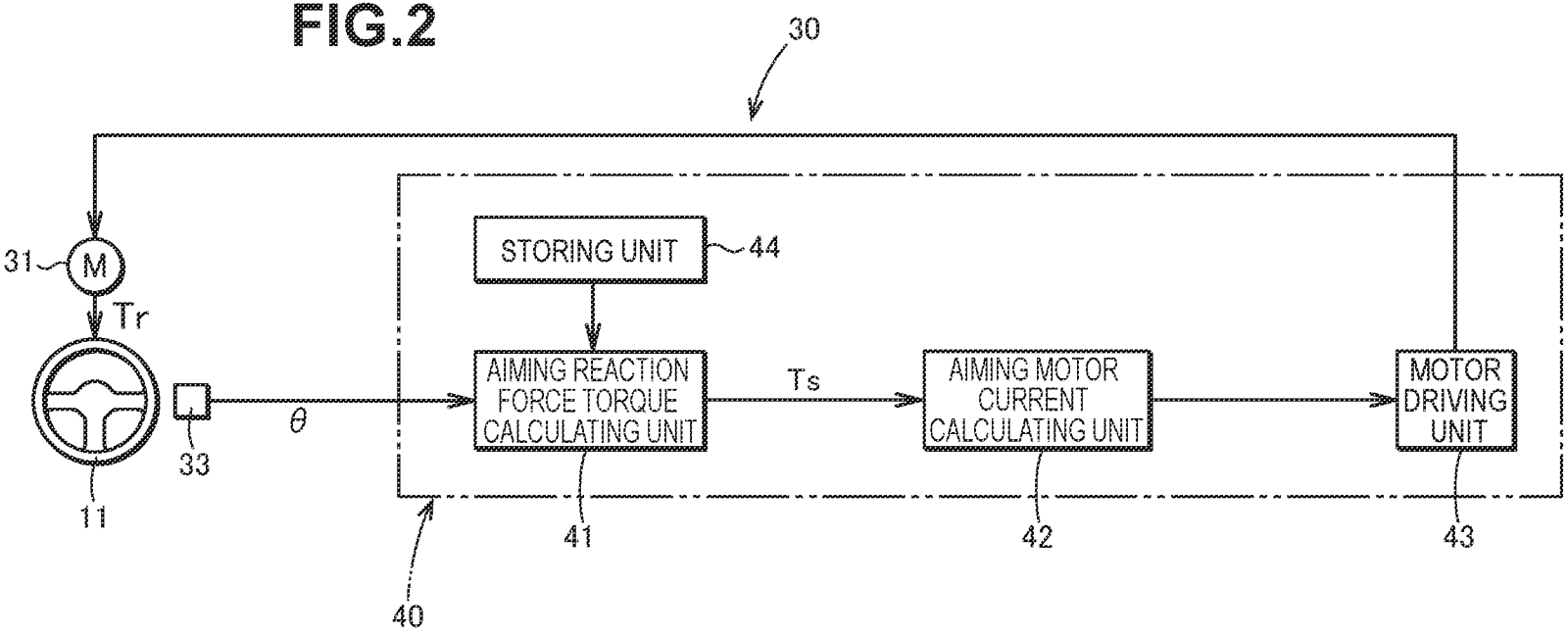
FIG. 2 is a block diagram for describing the details of a control on the ship steering device illustrated in FIG. 1.
Figure 3:
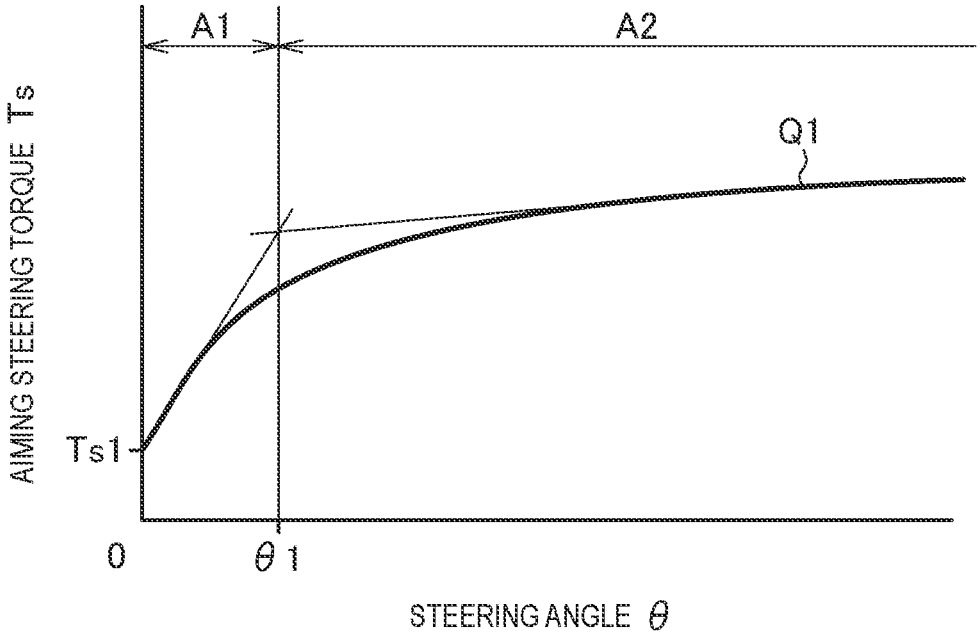
FIG. 3 is a conceptual diagram for a steering characteristics map stored in a storing unit illustrated in FIG. 2.

With reference to FIGS. 1 to 3, a ship 10 according to a first embodiment, and a ship steering device 30 loaded on the ship 10 will be described.

As illustrated in FIG. 1, the ship 10 includes a handle 11 (a steering member 11) at the front side, and also includes an outboard motor 12 at the rear side. The outboard motor 12 includes an outboard motor body 13, a propeller 14 provided below the outboard motor body 13, and a power source 15 that drives the propeller 14. The front section of the outboard motor 12 is supported by a swivel shaft 16 perpendicular to the ship 10 so as to be swingable to the right and left sides, and the front section of the outboard motor 12 is coupled to a rudder mechanism 20.

The rudder mechanism 20 includes, for example, a fixed shaft 21 elongated in the widthwise direction of the ship 10, a rudder motor 23 that has an output shaft connected to the fixed shaft 21 through a ball screw mechanism 22, a movable body 24 movable together with the rudder motor 23 along the fixed shaft 21, and a linkage mechanism 25 coupled to the movable body 24. This linkage mechanism 25 is coupled to the outboard motor body 13.

The power by the rudder motor 23 is converted into a linear motion of the movable body 24 in the direction along the fixed shaft 21 through the ball screw mechanism 22. The linear motion of the movable body 24 is converted into a right-and-left swing motion of the outboard motor 12 around the swivel shaft 16 through the linkage mechanism 25. Thus, the rudder mechanism 20 is steered by changing the direction of the outboard motor 12 by the power of the rudder motor 23.

The ship steering device 30 employs a so-called steer-by-wire structure in which the handle 11 at the operator's seat and the rudder mechanism 20 of the outboard motor 12 are mechanically separated from each other, and the rudder mechanism 20 can be electrically steered via the handle 11.

The handle 11 is, for example, a steering wheel, and includes a steering shaft 11*a*. A reaction force motor 31 that applies steering reaction force (reaction force torque) to the handle 11 is coupled to the steering shaft 11*a*. The reaction force motor 31 (being included in various kinds of unillustrated actuators) gives a steering feeling to a ship handling person by generating reaction force torque against the steering force of the handle 11 turned by the ship handling person. The reaction force motor 31 is an electric motor.

In this example, "reaction force torque Tr" means torque in the opposite direction to the steering direction regarding the handle 11. Basically, when the handle 11 and the rudder mechanism 20 are mechanically separated, there may be no response for a steering operation. In order to address this technical problem, the reaction force motor 31 gives torque to the handle 11 in the opposite direction to the steering direction by the ship handling person. Hence, the ship handling person can carry out the steering operation while feeling torque (reaction force torque Tr) as a response of the steering operation. The reaction force torque Tr is designed in view of steering torque necessary when the handle 11 and the rudder mechanism 20 are mechanically coupled to each other.

Steering information on the handle 11 is transmitted to a controller 32. An example or a piece of the steering information is or includes a steering angle θ of the handle 11 detected by a steering angle detecting unit 33.

The controller 32 is, for example, an Electronic Control Unit (ECU) including a microcomputer, etc., and drives and controls the rudder motor 23 based on various kinds of information including the steering information on the handle 11. Moreover, the controller 32 includes a reaction force controller 40 that drives and controls the reaction force motor 31.

As illustrated in FIG. 2, the reaction force controller 40 includes a plurality of functional calculating units accomplished by, for example, software when a computer executes predetermined program processes. The reaction force controller 40 includes an aiming reaction force torque calculating unit 41 that calculates aiming reaction force torque in accordance with the steering angle θ detected by the steering angle detecting unit 33, an aiming motor current calculating unit 42 that decides an aiming current for the reaction force motor 31 in accordance with the aiming reaction force torque output by the aiming reaction force torque calculating unit 41, and a motor driving unit 43 that drives the reaction force motor 31 by, for example, PWM control in accordance with the aiming current output by the aiming motor current calculating unit 42.

The reaction force motor 31 driven as described above applies the reaction force torque Tr to the handle 11 in the opposite direction to the steering direction.

The reaction force controller 40 includes a storing unit 44 that stores a steering characteristics map. Alternatively, the storing unit 44 may be configured separately from the reaction force controller 40.

With reference to also FIG. 3, the steering characteristics map associates a basic relationship between the steering angle θ detected by the steering angle detecting unit 33 with aiming steering torque Ts required for the handle 11, i.e., the steering characteristics map can map such an associated relationship. The steering characteristics in accordance with the steering characteristics map are the same characteristics in both the right steering operation of the handle 11 and in the left steering operation thereof.

In this example, the operation of the handle 11 by the ship handling person will be defined as follows. An operation of increasing the steering angle θ of the handle 11 by the ship handling person will be referred to as a "steering increase operation". An operation of reducing the steering angle θ of the handle 11 by the ship handling person, i.e., an operation of returning the handle 11 to the neutral direction will be referred to as a "steering return operation".

As illustrated in FIG. 3, the steering characteristics map has characteristics of a curve Q1 (a basic characteristic curve Q1 indicated by a thick line) for obtaining the aiming steering torque Ts relative to the steering angle θ with the horizontal axis representing the steering angle θ and the vertical axis representing the aiming steering torque Ts.

According to the basic characteristic curve Q1, when a steering angle θ is zero, i.e., when the handle 11 is at the neutral position, the aiming steering torque Ts is set as a constant value Ts1 in advance. This constant value Ts1 will be referred to as a "steering torque insensible value Ts1". Since the steering torque insensible value Ts1 is set in the basic characteristic curve Q1, when the steering increase operation is given to the handle 11 located at the neutral position (θ=0), the steering torque Ts that exceeds the steering torque insensible value Ts1 is necessary. Since the shaking of the handle 11 in the steering direction can be restricted, a feeling of operating the ship so as to surely travel straight can be given to the ship handling person when the ship 10 travels straight. The same is true of both the right steering operation of the handle 11 and the left steering operation thereof.

Moreover, the basic characteristic curve Q1 has characteristics in such a way that the aiming steering torque Ts increases in an ever-increasing manner from the steering torque insensible value Ts1 in accordance with an increase in the steering angle θ. More specifically, the basic characteristic curve Q1 has characteristics in such a way that the amount of change in the aiming steering torque Ts relative to the steering angle θ is small in a second steering region A2 (where the steering angle θ is larger than that of a first steering region A1) relative to the change amount of the aiming steering torque Ts in the first steering region A1 where the steering angle θ is preset in advance from zero.

That is, in the first steering region A1, relative to the amount of change in the steering angle θ, the amount of change in the aiming steering torque Ts is larger than that of the second steering region A2. In the second steering region A2, relative to the amount of change in the steering angle θ, the amount of change in the aiming steering torque Ts is smaller than that of the first steering region A1. Near the boundary (where the steering angle θ is boundary torque θ1) between the first steering region A1 and the second steering region A2, the aiming steering torque Ts changes curvilinearly relative to the steering angle θ.

Next, with reference to FIG. 2 and FIG. 3, the actions of the reaction force controller 40 will be described. The aiming reaction force torque calculating unit 41 obtains the aiming reaction force torque in accordance with the steering angle θ detected by the steering angle detecting unit 33 and with the characteristics of the steering characteristics map illustrated in FIG. 3, and outputs a reaction force commanding signal in accordance with the aiming reaction force torque to the aiming motor current calculating unit 42. The aiming motor current calculating unit 42 decides the aiming current for the reaction force motor 31 in accordance with the aiming reaction force torque output by the aiming reaction force torque calculating unit 41, and controls a current to be output to the reaction force motor 31 in accordance with the aiming current. The motor driving unit 43 drives the reaction force motor 31 in accordance with a current control signal output by the aiming motor current calculating unit 42.

As described above, based on the steering characteristics map, the reaction force controller 40 controls a drive current value that drives the reaction force motor 31 in such a way that the aiming steering torque Ts in accordance with the steering angle θ is obtained.

The first embodiment can be summarized as follows.

As illustrated in FIG. 1 to FIG. 3, the ship steering device 30 includes: the outboard motor 12 attachable to the ship 10; the handle 11 which is mechanically separated from the rudder mechanism 20 of the outboard motor 12, and which is capable of electrically operating the rudder mechanism 20; the steering angle detecting unit 33 that detects the steering angle θ of the handle 11; the reaction force motor 31 that generates the reaction force torque Tr to be applied to the handle 11; the storing unit 44 that stores the steering characteristics map which associates a basic relation between the steering angle θ and the aiming steering torque Ts required for the handle 11; and the reaction force controller 40 that controls, based on the steering characteristics map, the drive current value which drives the reaction force motor 31 in such a way that the reaction force torque Tr in accordance with the steering angle θ is obtained. The steering characteristics map has characteristics in such a way that the amount of change in the aiming steering torque relative to the steering angle θ is smaller in the second steering range A2 where the steering angle θ is larger than the steering angle in the first steering range A1 than the change amount of the aiming steering torque in the first steering region A1 where the steering angle θ is set in advance from zero.

As described above, the reaction force controller 44 controls the reaction force motor 31 based on the steering characteristics map that associates the steering angle θ with the aiming steering torque Ts. That is, the same steering characteristics map is applied in both the right steering operation of the handle 11, and the left steering operation thereof. This enables an operation of the rudder mechanism 20 with the same steering feeling at the time of the right steering operation and of the left steering operation. The ship handling person can turn the handle while feeling the same reaction force torque Tr in the right and left directions as the responses to the right and left operations of the handle 11. Consequently, the steer-by-wire type ship steering device 30 that prevents an occurrence of strange feeling in a steering operation can be provided.

Moreover, in the steering characteristics map, the characteristics of the amount of change (a gradient) in the aiming steering torque Ts relative to the steering angle θ is set so as to be large in the first steering region A1 (where the steering angle θ is small), and is set so as to be small in the second steering region A2 (where the steering angle θ is large).

In general, in a region where the steering angle θ is small, i.e., in a state in which physical quantities that are the characteristics of the ship 10, such as an acceleration in the lateral direction (a lateral acceleration), a yaw rate, and the inclined amount (inclined angle) of the ship 10, are small, the ship handling person is likely to grab the handle 11 gently, and carry out a steering operation with weak force being applied to the ship handling person's hands and arms. Hence, it is difficult to control the steering angle of the handle 11, and thus the steering operation is carried out using the steering torque information that has a strong correlation with the behavior of the ship 10.

In contrast, according to the first embodiment, when the steering increase operation is given to the handle 11, the steering operation is performed in the first steering region A1 where the amount of change (a gradient) in the aiming steering torque Ts relative to the steering angle θ of the handle 11 is large, and the change thereof can be easily felt as the steering feeling.

Conversely, in the region where the steering angle θ is large, i.e., in a state in which the physical quantities that are the characteristics of the ship 10, such as the acceleration in the lateral direction (a lateral acceleration), the yaw rate, and the inclined amount (inclined angle) of the ship 10, are large, the ship handling person is likely to grab the handle 11 with strength, and carry out the steering operation with intensive force being applied to the ship handling person's hands and arms. Since the detection precision for the steering torque at the position of a hand decreases, the precision on the control of the steering angle θ increases. Hence, since the steering angle θ can be easily controlled when the steering torque characteristics are gentle, the steering operation is carried out in the second steering region A2.

In view of the above-described relationships, as illustrated in FIG. 3, regarding the basis characteristics that ensure the controllability, in the first steering region A1 where the steering angle θ is small, the amount of change in the aiming steering torque Ts relative to the steering angle θ is set to be large, and in the second steering region A2 where the steering angle θ is large, the amount of change in the aiming steering torque Ts relative to the steering angle θ is set to be small. As described above, by changing the amount of change in the aiming steering torque Ts in the steering region A1 and in the steering region A2, the controllability by the handle 11 improves.

Note that in the steering characteristics map, the boundary (the boundary torque θ1) between the first steering region A1 and the second steering region A2 is designed optimally in view of the easiness of the ship handling person to turn the handle 11.

Second Embodiment

A ship steering device 130 according to a second embodiment will be described with reference to FIG. 4 to FIG. 5. The ship steering device 130 of the second embodiment has a feature such that a ship speed detecting unit 131 is added to the structure of the first embodiment. The detailed description for the same structure as that the first embodiment will be omitted.

Figure 4:
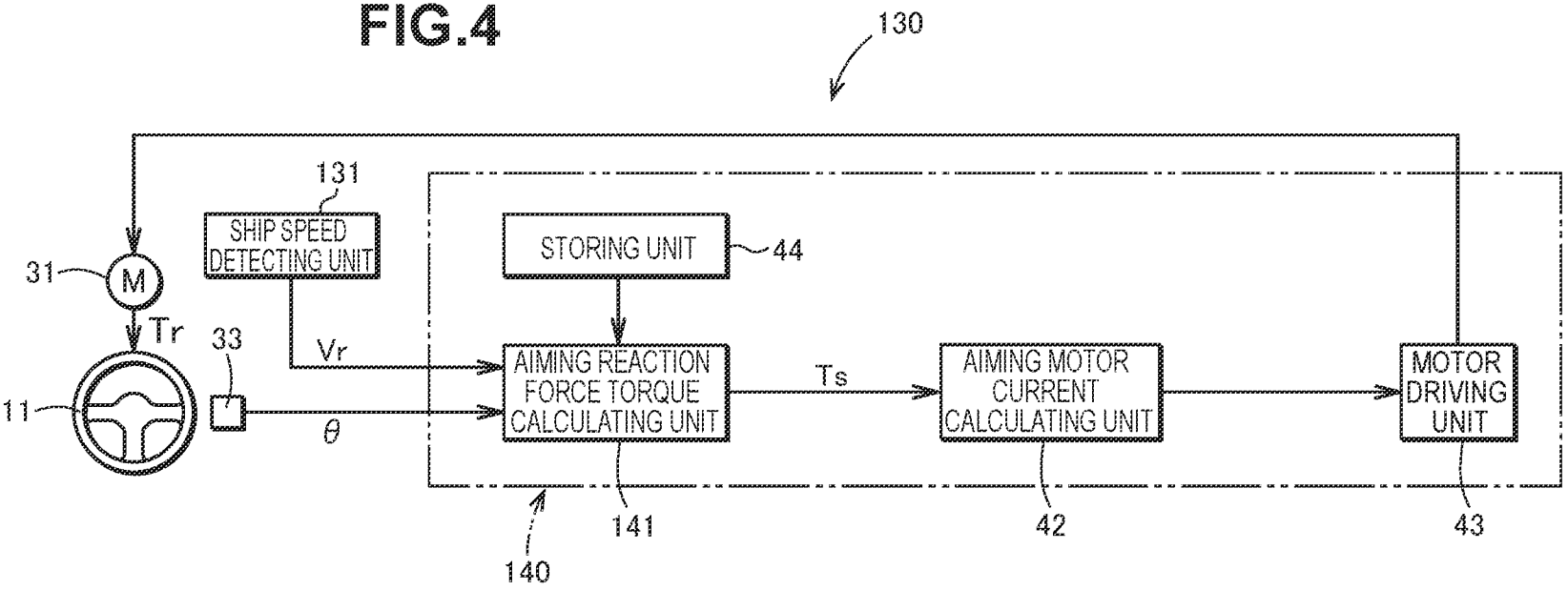
FIG. 4 is a block diagram for describing the details of a control on a ship steering device according to a second embodiment.

As illustrated in FIG. 4, the ship steering device 130 of the second embodiment includes the ship speed detecting unit 131 that detects a speed Vr (a ship speed Vr) of the ship 10. The reaction force controller 140 corresponds to the reaction force controller 40 of the first embodiment (see FIG. 2). The aiming reaction force torque calculating unit 141 of the reaction force controller 140 calculates the aiming reaction force torque in accordance with the steering angle θ and with the ship speed Vr. A steering characteristics map illustrated in FIG. 5 has characteristics in such a way that the faster the speed Vr (the ship speed Vr) is, the larger the aiming steering torque Ts relative to the steering angle θ becomes.

Figure 5:
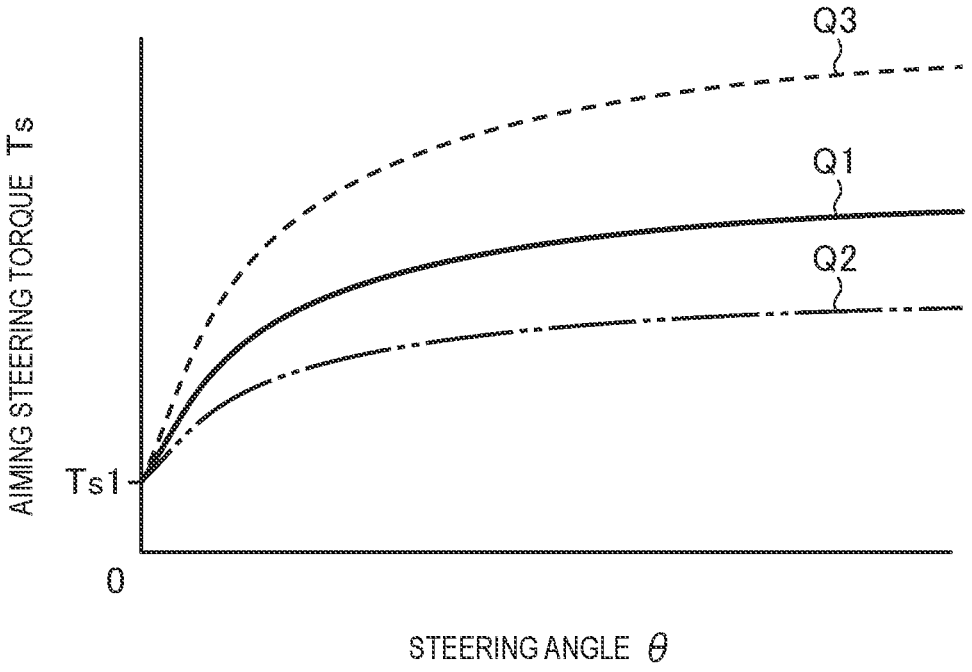
FIG. 5 is a conceptual diagram of a steering characteristics map stored in a storing unit illustrated in FIG. 4.

For example, according to the steering characteristics map illustrated in FIG. 5, the basic characteristic curve Q1 of the first embodiment (see FIG. 3) is adopted as the characteristic curve in the case of a reference ship speed set in advance. With reference to the basic characteristic curve Q1, when the ship speed Vr is slower than the reference ship speed, a low-speed characteristic curve Q2 indicated by a two-dot line is set, and when the ship speed Vr is faster than the reference ship speed, a fast-speed characteristic curve Q3 indicated by a broken line is set. Note that the characteristic curves in accordance with the ship speed Vr are not limited to three curves that are Q1, Q2, and Q3, and the number of characteristic curves in accordance with the ship speed Vr may be equal to or greater than four.

As described above, the steering characteristics map has characteristics in such a way that the faster the speed Vr (the ship speed Vr) of the ship 10 is, the larger the aiming steering torque Ts becomes relative to the steering angle θ. Since the reaction force torque Tr in accordance with the ship speed Vr can be applied to the handle 11, a load on the ship handling person when carrying out the steering operation can be reduced, while at the same time, the controllability of the ship steering device 130 can be further improved. The other actions and effects are the same as those of the above-described first embodiment.

Third Embodiment

A ship steering device 230 according to a third embodiment will be described with reference to FIG. 6. The ship steering device 230 of the third embodiment has a feature such that a reaction force torque detecting unit 231 and a corrected motor current calculating unit 232 for performing a feedback control are added to either one structure of the first and second embodiments. In this example, a structure is illustrated in which the reaction force torque detecting unit 231 and the corrected motor current calculating unit 232 are added to the structure of the second embodiment, and the detailed description for the same structure as that of the second embodiment will be omitted.

Figure 6:
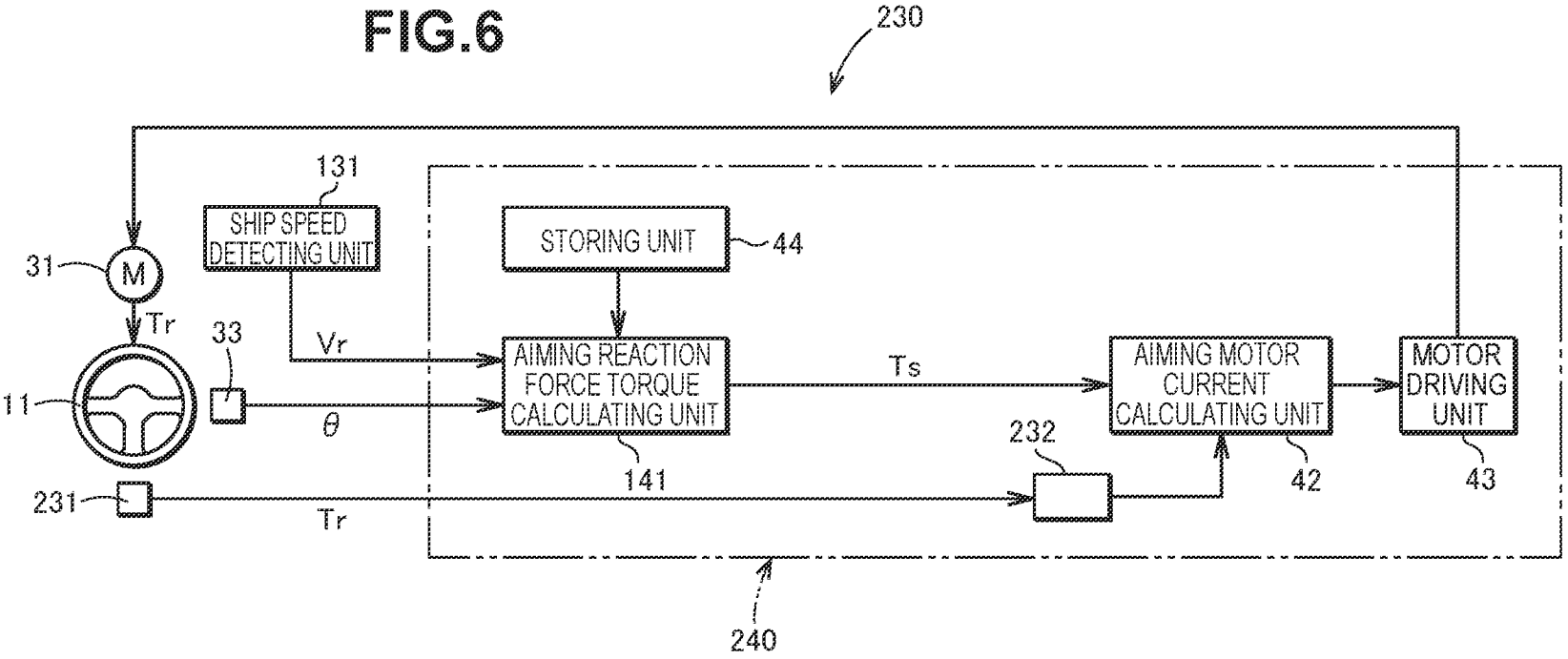
FIG. 6 is a block diagram for describing the details of a control on a ship steering device according to a third embodiment.

As illustrated in FIG. 6, the reaction force torque detecting unit 231 detects the reaction force torque Tr applied to the handle 11 from the reaction force motor 31. The reaction force controller 240 corresponds to the reaction force controller 140 of the second embodiment (see FIG. 4). The corrected motor current calculating unit 232 of the reaction force controller 240 sets a corrected current in accordance with the reaction force torque Tr detected by the reaction force torque detecting unit 231, and corrects the aiming current of the aiming motor current calculating unit 42. Consequently, a feedback control is enabled.

As described above, the ship steering device 230 of the third embodiment includes the reaction force torque detecting unit 231 that detects the reaction force torque Tr applied to the handle 11 from the reaction force motor 31. The reaction force controller 240 executes the feedback control based on the reaction force torque Tr detected by the reaction force torque detecting unit 231.

Hence, even if an environmental (e.g., a temperature) change of the ship steering device 230 and a change in the mechanical frictional force of each component of the ship steering device 230 due to time-based deterioration, etc., occur, the stable reaction force torque Tr can be applied to the handle 11. Therefore, the controllability of the ship steering device 230 can be further improved. The other actions and effects are the same as those of the above-described second embodiment.

Fourth Embodiment

Figure 7:
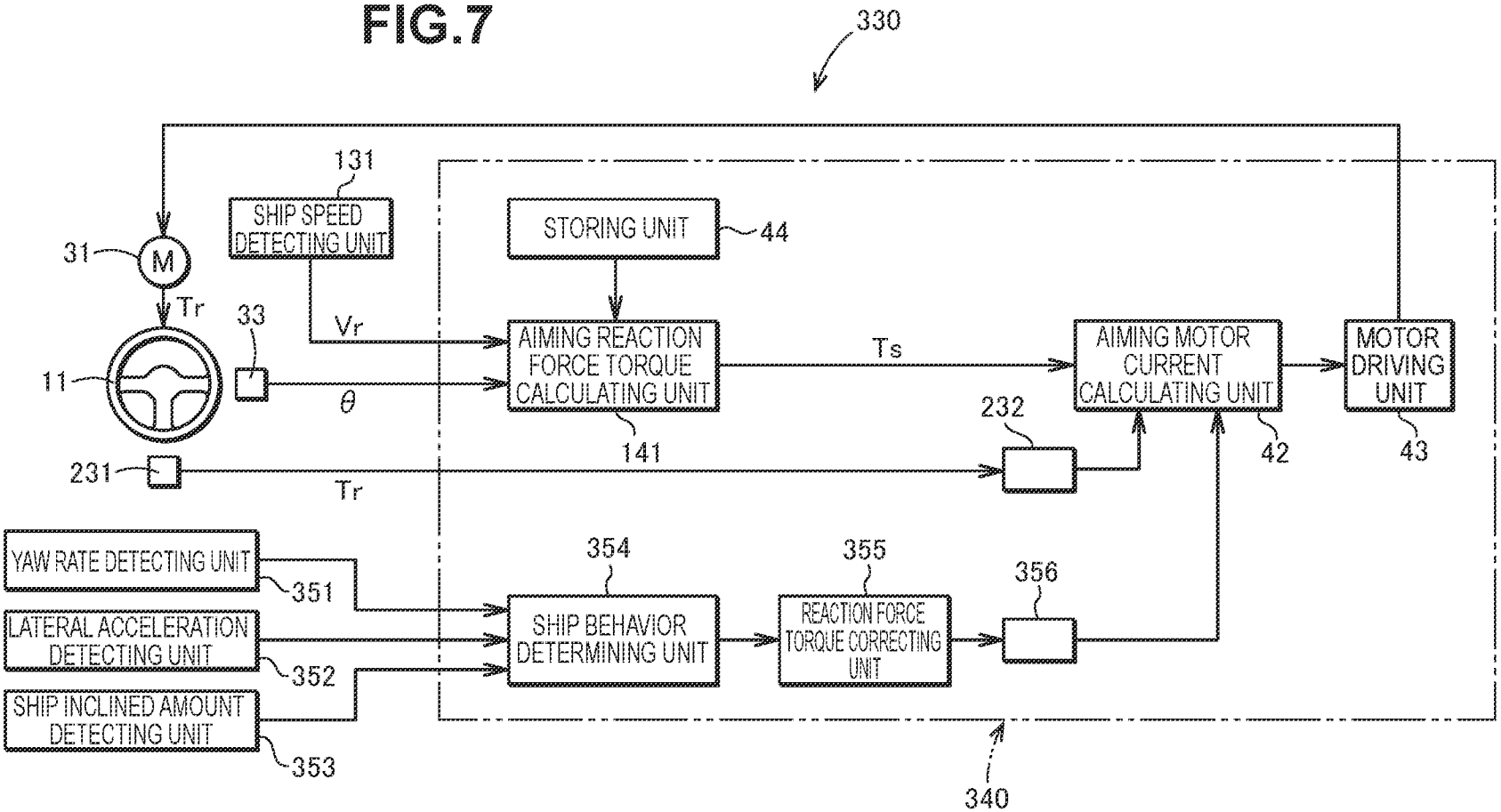
FIG. 7 is a block diagram for describing the details of a control on a ship steering device according to a fourth embodiment.

A ship steering device 330 according to a fourth embodiment will be described with reference to FIG. 7. The ship steering device 330 of the fourth embodiment has a feature such that various kinds of detecting units 351 to 353, a ship behavior determining unit 354, a reaction force torque correcting unit 355, and a corrected motor current calculating unit 356 are added to the structure of any one of the first to third embodiment for correcting the motor current in accordance with the behavior of the ship 10. In this example, a structure in which the various kinds of detecting units 351 to 353, the ship behavior determining unit 354, the reaction force torque correcting unit 355, and the corrected motor current calculating unit 356 are added to the structure of the third embodiment will be described as an example, and the detailed description on the same structure as that the third embodiment will be omitted.

The ship behavior determining unit 354, the reaction force torque correcting unit 355, and the corrected motor current calculating unit 356 are included in a reaction force controller 340. The reaction force controller 340 corresponds to the reaction force controller 240 of the third embodiment (see FIG. 6).

The ship behavior determining unit 354 compares the characteristics of physical quantities which occur and change due to the behavior of the ship 10 with reference characteristics (the calculated amount from the motion equation of the ship 10, the measured value when the water surface environment is stable, etc.), thereby determining the behavior of the ship 10.

Example detecting units that detect the physical quantities which occur and change due to the behavior of the ship 10 for allowing the ship behavior determining unit 354 to determine are a yaw rate detecting unit 351, a lateral acceleration detecting unit 352, and a ship inclined amount detecting unit 353. The yaw rate detecting unit 351 detects a speed (a yaw rate) at which the rotation motion (yawing) changes around the vertical axis of the ship 10 when the ship 10 is travelling. The lateral acceleration detecting unit 352 detects the acceleration in the lateral direction applied to the ship 10 when the ship 10 turns. The ship inclined amount detecting unit 353 detects the attitude (an inclination angle) of the ship 10.

By changing the steering torque characteristics in accordance with the physical quantities, such as the yaw rate, the acceleration in the lateral direction, and the inclination angle, relating to the behavior of the ship 10, the ship handling person can feel the behavior of the ship 10 through the handle 11 that has a physical tightening between the ship body 10 and the ship handling person.

The reaction force torque correcting unit 355 corrects the aiming reaction force torque output by the aiming reaction force torque calculating unit 141 based on the determination result of the behavior of the ship 10 determined by the ship behavior determining unit 354. The corrected motor current calculating unit 356 decides the corrected current in accordance with a correction value output by the reaction force torque correcting unit 355, and corrects the aiming current of the aiming motor current calculating unit 42.

As described above, the ship steering device 330 of the fourth embodiment includes the ship behavior determining unit 354 that determines the behavior of the ship 10. In accordance with the change in the behavior of the ship 10 determined by the ship behavior determining unit 354, the reaction force controller 340 corrects the drive current value so as to correct the characteristics of the aiming steering torque Ts relative to the steering angle θ.

For example, the reaction force controller 340 executes the correction in such a way that the larger the change in the behavior of the ship 10 determined by the ship behavior determining unit 354 is, the greater the value of the aiming steering torque Ts relative to the steering angle θ becomes. Hence, the characteristics of the aiming steering torque Ts relative to the steering angle θ can be changed in accordance with the behavior of the ship 10. Therefore, the controllability of the ship steering device 330 can be further improved. The other actions and effects are the same as those of the above-described third embodiment.

Fifth Embodiment

A ship steering device according to a fifth embodiment will be described with reference to FIG. 1 to FIG. 3, and also FIG. 8. The ship steering device of the fifth embodiment has a feature such that some of the characteristics of the steering characteristics map (see FIG. 3) of the ship steering device 30 of the first embodiment (see FIG. 2) are changed to the characteristics of a steering characteristics map illustrated in FIG. 8. The changes in the characteristics of the steering characteristics map and the details related thereto will be described below, and the others are the same as those of the first embodiment. Hence, the detailed description thereof will be omitted.

Figure 8:
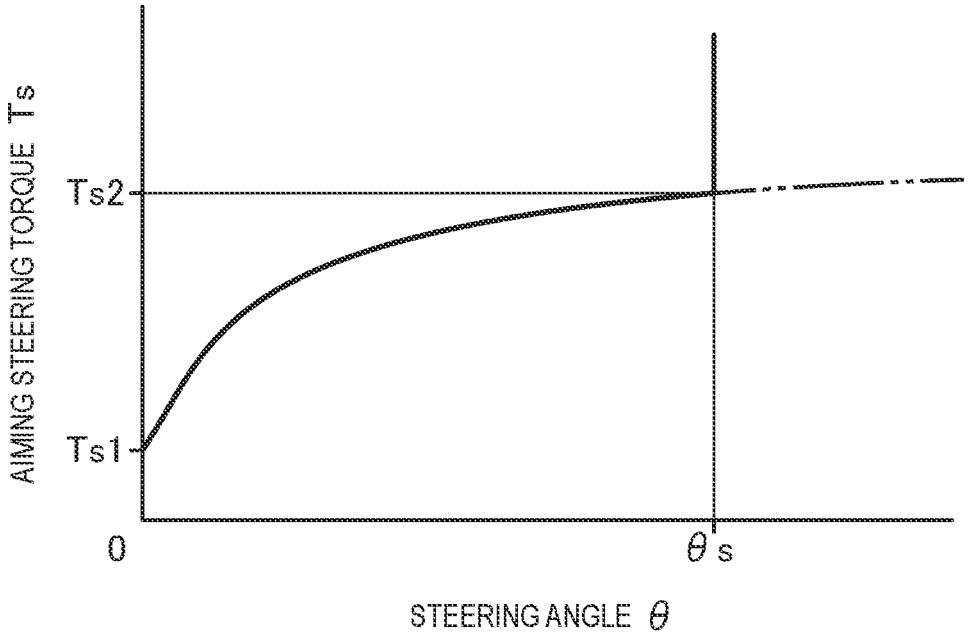
FIG. 8 is a conceptual diagram of a steering characteristics map of a ship steering device according to a fifth embodiment.

As illustrated in FIG. 8, the steering characteristics map of the fifth embodiment has characteristics that keenly increase the aiming steering torque Ts (e.g., the characteristics that make the aiming steering torque Ts infinite) when the steering angle θ reaches an upper limit value θs that is set in advance.

By setting the upper limit value θs of the steering angle θ, the further steering increase operation of the handle 11 by the ship handling person beyond such a limit is restricted. By restricting the excessive steering increase operation, the behavior of the ship 10 can be maintained within a stable range. The other actions and effects are the same as those of the above-described first embodiment.

Sixth Embodiment

A ship steering device 430 according to a sixth embodiment will be described with reference to FIG. 9 to FIG. 10. The ship steering device 430 of the sixth embodiment has a feature such that a steering angle direction determining unit 441 and a hysteresis characteristic unit 442 for applying hysteresis characteristics are added to the structure of any one of the first to fifth embodiment. In this example, a structure in which the steering angle direction determining unit 441 and the hysteresis characteristic unit 442 are added to the structure of the fourth embodiment will be described as an example, and the detailed description on the same structure as that the fourth embodiment will be omitted.

The steering angle direction determining unit 441 and the hysteresis characteristic unit 442 are included in a reaction force controller 440. The reaction force controller 440 corresponds to the reaction force controller 340 of the fourth embodiment (see FIG. 7).

The steering angle direction determining unit 441 determines the steering direction of the handle 11 based on the steering angle θ detected by the steering angle detecting unit 33. When the steering angle direction determining unit 441 determines that the steering direction of the handle 11 is the steering return direction, the hysteresis characteristic unit 442 executes arithmetic processing so as to execute a second characteristic Q4 (a hysteresis characteristic) in the steering characteristics map illustrated in FIG. 10.

Figure 10:
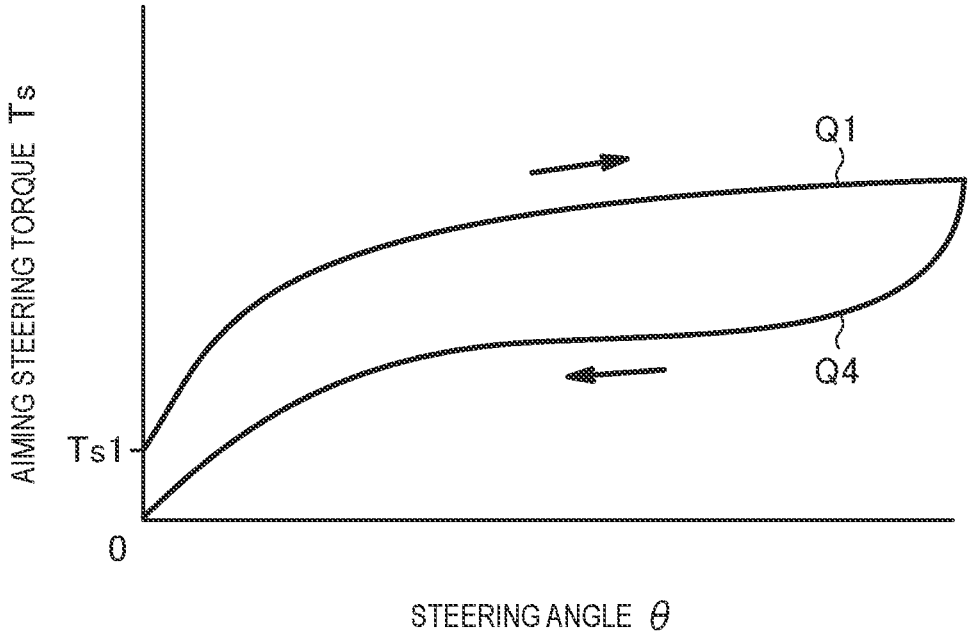
FIG. 10 is a conceptual diagram of a steering characteristics map stored in a storing unit illustrated in FIG. 9.

As illustrated in FIG. 10, the steering characteristics map has the first characteristic Q1 of the aiming steering torque when the steering increase operation is given to the handle 11, and the second characteristic Q4 of the aiming steering torque when the steering return operation is given to the handle 11. The first characteristic Q1 adopts the basic characteristic curve Q1 of the first embodiment (see FIG. 3). The second characteristic Q4 is a hysteresis characteristic that becomes smaller than the first characteristic Q1 when the operation changes from the steering increase operation to the steering return operation. According to the second characteristic Q4, when the steering angle θ is zero, i.e., when the handle 11 is at the neutral position, the aiming steering torque Ts is set to be zero.

Note that when the steering angle direction determining unit 441 determines that the steering direction of the handle 11 is the steering return direction, the reaction force controller 440 itself may execute arithmetic processing so as to execute the second characteristic Q4 (the hysteresis characteristic) in the steering characteristics map illustrated in FIG. 10. In that case, the hysteresis characteristic unit 442 is unnecessary.

The sixth embodiment can be summarized as follows.

Figure 9:
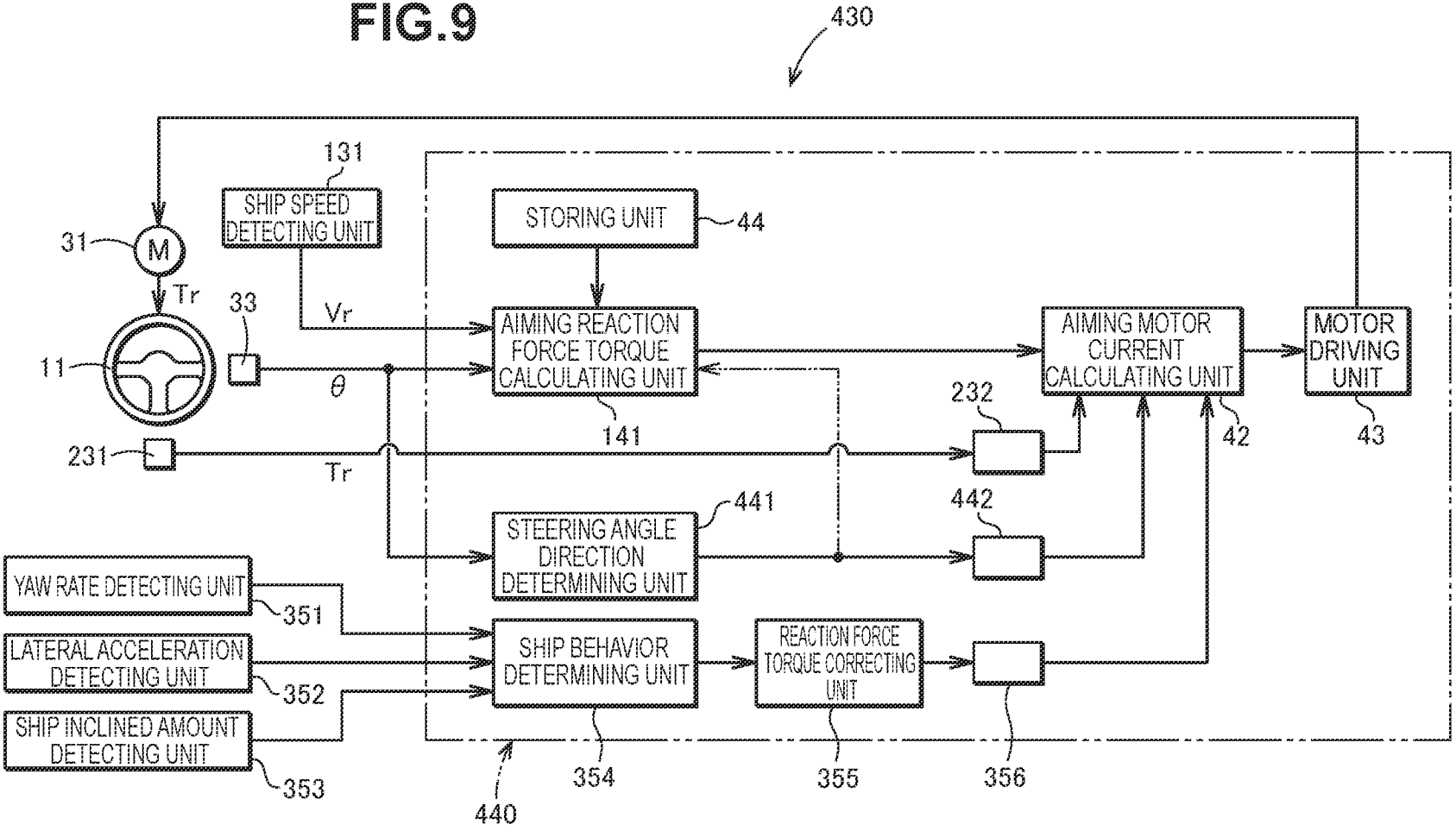
FIG. 9 is a block diagram for describing the details of a control on a ship steering device according to a sixth embodiment.

As illustrated in FIG. 9, the ship steering device 430 according to the sixth embodiment includes the steering angle direction determining unit 441 that determines the steering direction of the handle 11 based on the steering angle θ. As illustrated in FIG. 10, the steering characteristics map according to the sixth embodiment has the first characteristic Q1 of the aiming steering torque relative to the steering angle θ when the steering direction is the steering increase direction, and the second characteristic Q4 of the aiming steering torque relative to the steering angle θ when the steering direction is the steering return direction, and also has a hysteresis in such a way that the second characteristic Q4 becomes smaller than the first characteristics Q1. In accordance with the steering direction determined by the steering angle direction determining unit 441, the reaction force controller 440 selects the first characteristic Q1 or the second characteristic Q2, and based on the selected characteristic, controls the drive current value that drives the reaction force motor 31 so as to obtain the reaction force torque Tr in accordance with the steering angle θ.

As described above, the steering characteristics map illustrated in FIG. 10 has a hysteresis characteristic in accordance with the steering direction of the handle 11. When the steering direction of the handle 11 is the steering return operation direction (the operation direction in which the handle is returned to the neutral position), a not-keen slope characteristic such that the torque characteristic of the aiming steering torque Ts relative to the steering angle θ is small. Even if the shaking of the ship 10 and that of the ship handling person occur due to disturbance, the turbulence of the rudder is suppressed, and thus the handling stability can be improved. The other actions and effects are the same as those of the above-described first embodiment or the sixth embodiment.

Seventh Embodiment

A ship steering device 530 according to a seventh embodiment will be described with reference to FIG. 11. The ship steering device 530 of the seventh embodiment has a feature such that a grip detecting unit 541, a steering retaining state determining unit 542, a handle return speed calculating unit 543, and a motor current addition and subtraction value calculating unit 544 for returning the handle 11 to the neutral position when the ship handling person releases the hands from the handle 11 are added to the structure of any one of the first to sixth embodiments. In this example, a structure in which the grip detecting unit 541, the steering retaining state determining unit 542, the handle return speed calculating unit 543, and the motor current addition and subtraction value calculating unit 544 are added to the structure of the sixth embodiment will be described as an example, and the detailed description on the same structure as that of the sixth embodiment will be omitted.

The steering retaining state determining unit 542, the handle return speed calculating unit 543, and the motor current addition and subtraction value calculating unit 544 are included in a reaction force controller 540. The reaction force controller 540 corresponds to the reaction force controller 440 of the fourth embodiment (see FIG. 9).

The grip detecting unit 541 detects whether or not the ship handling person is gripping the handle 11. For example, this unit includes an electrical capacitance type sensor provided in the handle 11.

The steering retaining state determining unit 542 determines whether or not it is in a state in which the ship handling person is grabbing the handle 11 and does not turn the handle, i.e., a so-called a steering retaining state. When, for example, the ship handling person grabs the handle 11 and maintains the preset steering angle θ, the steering retaining state determining unit 542 determines that it is in the steering retaining state. This steering retaining state determining unit 542 makes a determination on the steering retaining state based on, for example, the detection signal from the grip detecting unit 541, and the steering angle θ detected by the steering angle detecting unit 33.

When the steering retaining state determining unit 542 determines that it is in the steering retaining state, the aiming reaction force torque calculating unit 41 controls the current value so as to suppress the turbulence of the rudder relative to the behavior of the ship 10. For example, the reaction force controller 540 executes arithmetic processing so as to execute the second characteristic Q4 (the hysteresis characteristic) in the steering characteristics map illustrated in FIG. 10.

When the steering retaining state determining unit 542 determines that it is changed from the steering retaining state to a steering non-retaining state, the handle return speed calculating unit 543 calculates a return speed so as to return the handle 11 to the neutral position (where θ=0) at a steering angle return speed that is set in advance. The motor current addition and subtraction value calculating unit 544 calculates the current value in accordance with the return speed from the handle return speed calculating unit 543, and adjusts the aiming current to be output by the aiming motor current calculating unit 42.

The seventh embodiment can be summarized as follows.

Figure 11:
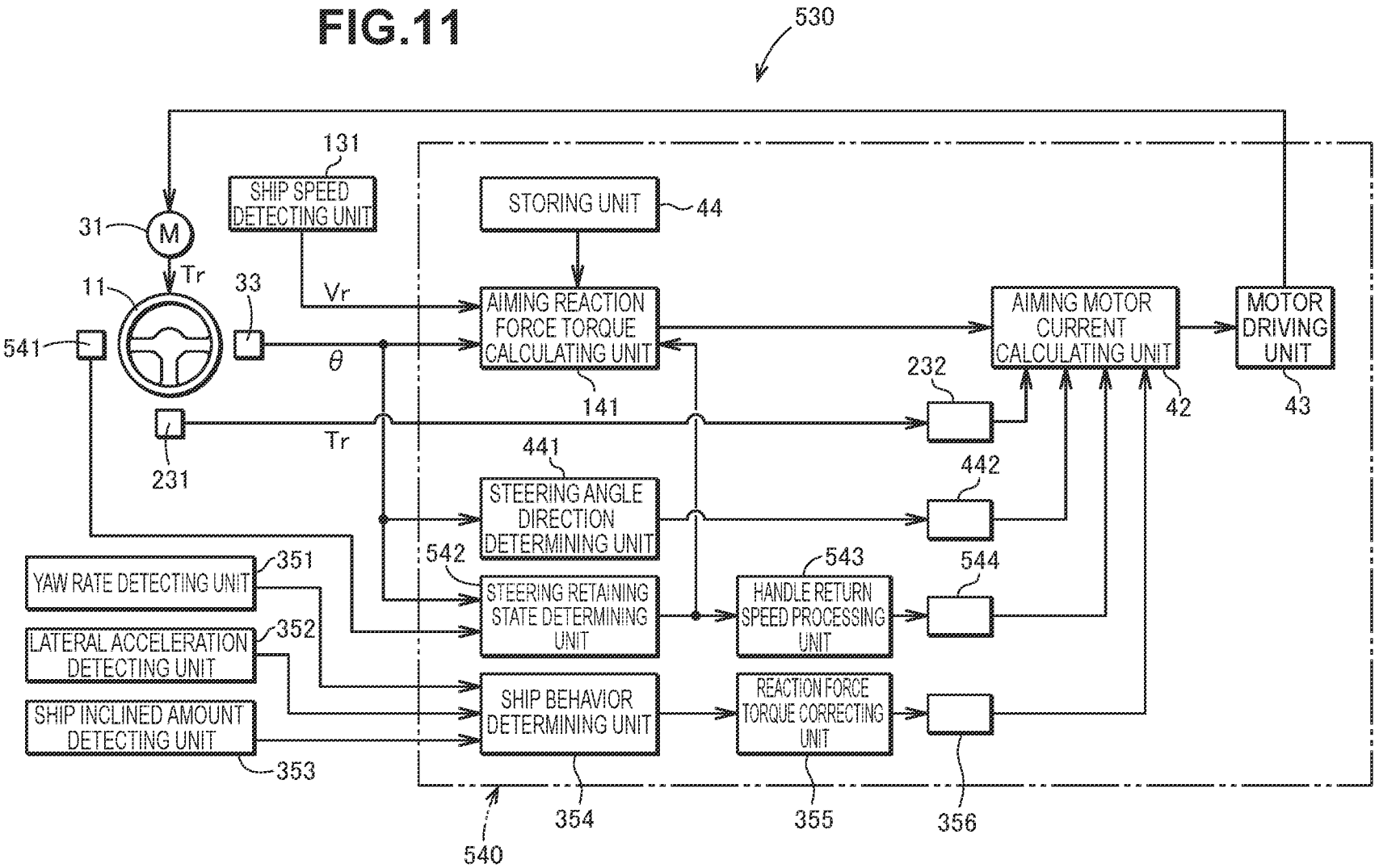
FIG. 11 is a block diagram for describing the details of a control on a ship steering device according to a seventh embodiment.

As illustrated in FIG. 11, the ship steering device 530 of the seventh embodiment includes: the grip detecting unit 541 that detects whether or not the handle 11 is in a gripped state, and the steering retaining state determining unit 542 that determines, under a condition in which the grip detecting unit 541 detects that the handle 11 is in the gripped state, whether or not it is in the steering retaining state in which the handle 11 is being gripped but no steering operation is given based on the steering angle θ detected by the steering angle detecting unit 33. The reaction force controller 540 executes the second characteristic Q4 in the steering characteristics map illustrated in FIG. 10 when the steering retaining state determining unit 542 determines that it is changed from the steering retaining state to the steering non-retaining state.

Hence, the current value can be controlled so as to suppress the turbulence of the rudder relative to the behavior of the ship 10. Even if the shaking of the ship 10 and that of the ship handling person occur by disturbance, the turbulence of the rudder is suppressed, and thus the handling stability can be improved.

Moreover, the reaction force controller 540 controls the drive current value that drives the reaction force motor 31 so as to return the handle 11 to the neutral position (θ=0) at the preset steering angle return speed when the grip detecting unit 541 detects a change from the state in which the handle 11 is gripped to the state in which the handle is not gripped.

When the ship handling person releases the hand from the handle 11, the handle 11 can be returned to the neutral position at the appropriate steering angle return speed. Hence, the handling stability can be improved, and the comfortability to the ship handling person can be also improved. The other actions and effects are the same as those of the above-described sixth embodiment.

Eighth Embodiment

A ship steering device 630 according to an eighth embodiment will be described with reference to FIG. 12. The ship steering device 630 of the eighth embodiment has a feature such that a steering retaining intent detecting unit 641, a steering intent detecting unit 642, a steering intent determining unit 643, and a drive current changing unit 644 for determining the intent of the ship handling person to carry out the steering operation are added to the structure of any one of the first to seventh embodiments. In this example, a structure in which the steering retaining intent detecting unit 641, the steering intent detecting unit 642, the steering intent determining unit 643, and the drive current changing unit 644 are added to the structure of the seventh embodiment, and the detailed description on the same structure as that of the seventh embodiment will be omitted.

The steering intent determining unit 643 and the drive current changing unit 644 are included in a reaction force controller 640. The reaction force controller 540 corresponds to the reaction force controller 540 of the seventh embodiment (see FIG. 11).

The steering retaining intent detecting unit 641 is operated when the ship handing person clarifies the intent to maintain the steering angle θ at the present time. This steering retaining intent detecting unit 641 includes, for example, an operation button or a touch panel that has a switch function, and a grip sensor that detects grip force, etc., by the ship handing person.

The steering intent detecting unit 642 detects that the ship handing person has the intent to carry out the steering operation by himself or herself. The steering intent detecting unit 642 includes, for example, a torque angle sensor built in the reaction force motor 31. The torque angle sensor detects the torque and angle of the reaction force motor 31.

The steering intent determining unit 643 includes a steering angle maintaining intent determining block 645 that determines whether or not the ship handing person has an intent to maintain the steering angle θ at the present time, and a steering start intent determining block 646 that determines whether or not the ship handling person has an intent to carry out the steering operation by himself or herself.

The steering angle maintaining intent determining block 645 (a turn steering retaining intent determining block 645) determines whether or not the ship handing person has an intent to maintain the steering angle θ at the present time (an intent to retain the steering) based on a detection signal from the steering retaining intent detecting unit 641.

The steering start intent determining block 646 determines whether or not the ship handing person has an intent to carry out the steering operation by himself or herself based on the detection signal from the steering intent detecting unit 642. For example, the steering start intent determining block 646 determines that the ship handing person has an intent to carry out the steering operation by himself or herself when, with the drive current changing unit 644 being outputting a steering retaining command, the change in a detection signal from the torque angle sensor 642 (the steering intent detecting unit 642) built in the reaction force motor 31 exceeds a threshold.

When the steering angle maintaining intent determining block 645 determines that the ship handing person has an intent to retain the steering, the drive current changing unit 644 gives a command (a steering retaining command) to the aiming motor current calculating unit 42 so as to maintain the steering angle θ at the present time. Subsequently, when the steering start intent determining block 646 determines that the ship handing person has an intent to carry out the steering operation by himself or herself, the drive current changing unit 644 cancels the command (gives a cancel command) to maintain the steering angle θ at the present time.

The eighth embodiment can be summarized as follow.

Figure 12:
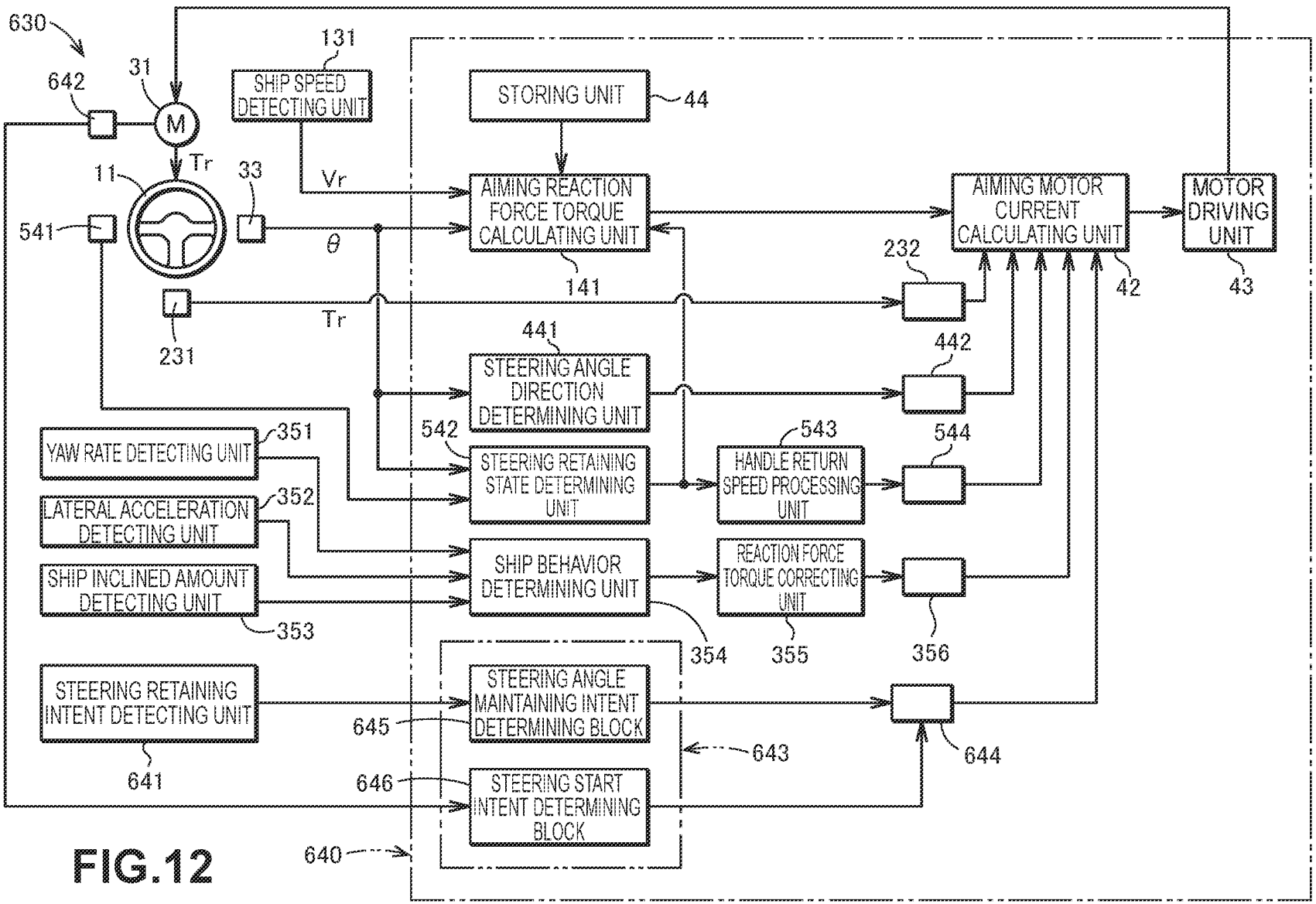
FIG. 12 is a block diagram for describing the details of a control on a ship steering device according to an eighth embodiment.

As illustrated in FIG. 12, the ship steering device 630 of the eighth embodiment includes the steering intent determining unit 643 that determines the intent of the ship handing person to carry out the steering operation. The reaction force controller 640 of the ship steering device 630 controls, when the steering intent determining unit 643 determines that the ship handing person has an intent to maintain the steering angle θ at the present time, the drive current value that drives the reaction force motor 31 so as to maintain the steering angle θ at the present time, and cancels, when the steering intent determining unit 643 determines that the ship handing person has an intent to carry out the steering operation by himself or herself, the control on the drive current value that maintains the steering angle θ at the present time by the reaction force motor 31.

By retaining the steering angle θ in accordance with the ship handing person's intent, the turning angle of the outboard motor 12 can be retained. This enables the ship handing person to handle the ship with the ship handing person's hands free like conventional electrically assisted hydraulic steering devices. Moreover, a normal steering operation can be maintained upon determining the steering operation intent by the ship handling person. The other actions and effects are the same as those of the above-described seventh embodiment.

Note that the present disclosure is not limited to the above-described embodiments as far as the actions and effects of the present disclosure are accomplishable.

For example, the ship steering devices 30, 130, 230, 330, 430, 530 and 630 cover a case in which the plurality of outboard motors 12 are loaded on the ship 10.

The ship steering devices 30, 130, 230, 330, 430, 530, and 630 of the respective embodiments can combine the plurality of the embodiments.

INDUSTRIAL APPLICABILITY

The ship steering devices 30, 130, 230, 330, 430, 530, and 630 of the present disclosure are suitable for the outboard motor 12 loaded on the small ship 10.

What is claimed is:

1. A ship steering device comprising:

an outboard motor attachable to a ship;

a handle which is mechanically separated from a rudder mechanism of the outboard motor, and which is capable of electrically operating the rudder mechanism;

a steering angle detecting unit that detects a steering angle of the handle;

a reaction force motor that generates reaction force torque to be applied to the handle;

a storing unit that stores a steering characteristics map which associates a basic relation between the steering angle and an aiming steering torque required for the handle; and a reaction force controller that controls, based on the steering characteristics map, a drive current value which drives the reaction force motor such that the reaction force torque in accordance with the steering angle is obtained, wherein the steering characteristics map has characteristics in such a way such that an amount of change in the aiming steering torque relative to the steering angle is smaller in a second steering range where the steering angle is larger than the steering angle in a first steering range than a change amount of the aiming steering torque in the first steering region where the steering angle is set in advance from zero.

2. The ship steering device according to claim 1, further comprising a ship speed detecting unit that detects a speed of the ship, wherein the steering characteristics map has characteristics such that the faster the speed is, the larger the aiming steering torque relative to the steering angle becomes.

3. The ship steering device according to claim 1, further comprising a reaction force torque detecting unit that detects the reaction force torque applied to the handle from the reaction force motor, wherein the reaction force controller executes a feedback control based on the reaction force torque detected by the reaction force torque detecting unit.

4. The ship steering device according to claim 1, further comprising a ship behavior determining unit that determines a behavior of the ship, wherein, in accordance with a change in the behavior of the ship determined by the ship behavior determining unit, the reaction force controller corrects the drive current value so as to correct a characteristic of the aiming steering torque relative to the steering angle.

5. The ship steering device according to claim 1, wherein the steering characteristics map has characteristics that keenly increases the aiming steering torque when the steering angle reaches an upper limit value that is set in advance.

6. The ship steering device according to claim 1, further comprising a steering angle direction determining unit that determines a steering direction of the handle based on the steering angle, wherein the steering characteristics map has a first characteristic of the aiming steering torque relative to the steering angle when the steering direction is a steering increase direction, and a second characteristic of the aiming steering torque relative to the steering angle when the steering direction is a steering return direction, and also has a hysteresis such that the second characteristic becomes smaller than the first characteristics, and wherein, in accordance with the steering direction determined by the steering angle direction determining unit, the reaction force controller selects the first characteristic or the second characteristic, and based on the selected characteristic, controls the drive current value that drives the reaction force motor so as to obtain the reaction force torque in accordance with the steering angle.

7. The ship steering device according to claim 6, further comprising:

a grip detecting unit that detects whether or not the handle is in a gripped state; and a steering retaining state determining unit that determines, under a condition in which the grip detecting unit detects that the handle is in the gripped state, whether or not a state is in a steering retaining state in which the handle is being gripped but no steering operation is given based on the steering angle detected by the steering angle detecting unit, wherein the reaction force controller executes the second characteristic in the steering characteristics map when the steering retaining state determining unit determines that the state is changed from the steering retaining state to a steering non-retaining state.

8. The ship steering device according to claim 7, wherein the reaction force controller controls the drive current value that drives the reaction force motor so as to return the handle to a neutral position at a preset steering angle return speed when the grip detecting unit detects a change from the state in which the handle is gripped to a state in which the handle is not gripped.

9. The ship steering device according to claim 6, further comprising a steering intent determining unit that determines an intent of a ship handling person to carry out a steering operation, wherein the reaction force controller:

controls, when the steering intent determining unit determines that the ship handling person has an intent to maintain the steering angle at a present time, the drive current value that drives the reaction force motor so as to maintain the steering angle at the present time; and cancels, when the steering intent determining unit determines that the ship handling person has an intent to carry out the steering operation by himself or herself, the control on the drive current value that maintains the steering angle at the present time by the reaction force motor.

* * * * *